US006466187B1

(12) United States Patent
Moon

(10) Patent No.: US 6,466,187 B1
(45) Date of Patent: Oct. 15, 2002

(54) DRIVING METHOD AND APPARATUS FOR PLASMA DISPLAY PANEL

(75) Inventor: Seong Hak Moon, Koonpo (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/546,602

(22) Filed: Apr. 10, 2000

(30) Foreign Application Priority Data

Apr. 10, 1999 (KR) ..... 99-12630

(51) Int. Cl.[7] ..... G09G 3/28
(52) U.S. Cl. ..... 345/63; 345/60; 345/690
(58) Field of Search ..... 345/60, 61, 62, 345/63, 64, 65, 66, 67, 68, 69, 70, 690, 691, 692, 693, 208, 209, 210, 211, 212, 213; 315/169.4

(56) References Cited

U.S. PATENT DOCUMENTS 6,037,917 A * 3/2000 Kawakami ..... 345/63
6,084,558 A * 7/2000 Setoguchi et al. ..... 345/60
6,084,559 A * 7/2000 Nagao et al. ..... 345/67
6,140,984 A * 10/2000 Kanazawa et al. ..... 345/67
6,243,073 B1 * 6/2001 Kawamura et al. ..... 345/60

* cited by examiner

*Primary Examiner*—Xiao Wu
(74) *Attorney, Agent, or Firm*—Fleshner & Kim, LLP

(57) ABSTRACT

A method and apparatus for driving a plasma display panel that is capable of expressing a gray level linearly. In the method and apparatus, the duty ratio of sustaining pulses applied in a sustaining interval in each sub-field is set differently. The sub-fields are combined in a certain arrangement sequence.

19 Claims, 9 Drawing Sheets

DRIVING METHOD AND APPARATUS FOR PLASMA DISPLAY PANEL

BACKGROUND OF THE INVENTION

1. Field of the Invention

This invention relates to driving method and apparatus for a plasma display panel, and more particularly to driving method and apparatus for a plasma display panel wherein a gray scale leves are linearized.

2. Description of the Related Art

Generally, a plasma display panel(PDP) radiates a Phosphor by an ultraviolet with a wavelength of 147 nm generated during a discharge of He+Xe or Ne+Xe gas to thereby display a picture including characters and graphics. Such a PDP is easy to be made into a thin-film and large-dimension type. Moreover, the PDP provides a very improved picture quality owing to a recent technical development. The PDP is largely classified into a direct current(DC) driving system and an alternating current(AC) driving system.

The PDP of AC driving system is expected to be highlighted into a future display device because it has advantages in the low voltage drive and a prolonged life in comparison to the PDP of DC driving system. Also, the PDP of alternating current driving system allows an alternating voltage signal to be applied between electrodes having dielectric layer therebetween to generate a discharge every half-period of the signal, thereby displaying a picture. The AC-type PDP makes a memory effect because it uses a dielectric material into the surface of which a wall charge is accumulated during the discharge.

Referring to FIG. 1, the AC-type PDP includes a front substrate 1 provided with a sustaining electrode pair 10, and a rear substrate 2 provided with address electrodes 4. The front substrate 1 and the rear substrate 2 are spaced, in parallel to each other, with having a barrier rib 3 therebetween. A mixture gas such as Ne–Xe or He–Xe, etc. is injected into a discharge space defined by the front substrate 1 and the rear substrate 2 and the barrier rib 3. Any one of the sustaining electrode pair 10 is used as a scanning/sustaining electrode that responds to a scanning pulse to cause an opposite discharge along with the address electrodes 4 and responds to a sustaining pulse to cause a surface discharge along with the opposite sustaining electrode 10. Also, the sustaining electrode 10 opposed to the sustaining electrode 10 used as the scanning/sustaining electrode are used as a common sustaining electrode to which a sustaining pulse is applied commonly. On the front substrate 1 provided with the sustaining electrode pair 10, a dielectric layer 8 and a protective layer 9 are disposed. The dielectric layer 8 is responsible for limiting a plasma discharge current as well as accumulating a wall charge during the discharge. The protective film 9 prevents a damage of the dielectric layer 8 caused by a sputtering generated during the plasma discharge and improves an emission efficiency of secondary electrons. This protective film 9 is usually made from MgO. Barrier ribs 3 for dividing the discharge space is extended perpendicularly at the rear substrate 2. On the surfaces of the rear substrate 2 and the barrier ribs 3 is provided a phosphor layer 5 which is excited by a vacuum ultraviolet lay to generate a visible light.

In such a PDP, one frame consists of a plurality of sub-fields and a gray level is expressed by a combination of the sub-fields. For instance, if it is intended to display a picture by 256 gray levels, then one frame interval (i.e., 16.67 ms) is time-divided into 8 sub-fields as shown in FIG. 2. Each of these 8 sub-fields is again divided into a reset interval, an address interval and a sustaining interval. In the reset interval, the full screen is initialized. In the address interval, discharge cells on which a data is to be displayed are selected by the address discharge. The selected discharge cells sustain the discharge in the sustaining interval. Herein, the reset interval and the address interval of each sub-field are same every sub-field, whereas the sustaining interval of each sub-field is assigned to be increased at a ratio of 2n(n=0, 1, 2, 3, 4, 5, 6, 7) at each sub-field in accordance with a relative brightness ratio. Since the sustaining interval becomes different at each sub-field as mentioned above, the sustaining interval of each sub-field, that is, a sustaining discharge frequency is controlled to express a gray level of picture.

Referring to FIG. 3, in the reset interval, a screen is initialized by a reset pulse applied between an address electrode(X) and a common sustaining electrode(Z). In the address interval, a data is supplied to the address electrode (X) and a scanning pulse synchronized with the data is sequentially applied to the scanning/sustaining electrode(Y). In the sustaining interval, a sustaining pulse having the same duty ratio of 1 is applied to the scanning/sustaining electrode (Y) and the common sustaining electrode(Z) as shown in FIG. 4.

In such a PDP driving method, a brightness difference is generated between sub-fields depending upon which sub-field is positioned between sub-fields. Specifically, gray level values 127 and 128 are a single gray level, but the gray level value 127 is a sum of the first to seventh sub-fields SF1 to SF7 at which a sustaining discharge is generated. On the other hand, the gray level value 128 generates the discharge only at the eighth sub-field(SF8). Accordingly, a brightness or gray level difference is generated at each sub-field to express a gray level value non-linearly. When a brightness difference between sub-fields is generated, a moving picture pseudo contour noise occurs. For instance, if the screen has been moved into the left side of the screen after the left half of the screen was displayed by a gray level value 128 and the right half of the screen was displayed by a gray level 127, then a white strip appears at the boundary portion between the gray level values 128 and 127. To the contrary, if the screen has been moved into the right side of the screen after the left half of the screen was displayed by a gray level value 128 and the right half of the screen was displayed by a gray level value 127, then a black stripe appears at the boundary portion between the gray level values 127 and 128.

In order to remove the pseudo contour noise, there have been one scheme of rearranging a sequence of sub-fields with the sustaining pulse having constant duty ratio and frequency and other scheme of dividing one sub-field to add one or two sub-fields to it. The pseudo contour noise may be reduced by the error diffusion method. However, such methods have drawbacks in that their implementation is very complicated and the brightness and gray level difference between sub-fields is still serious.

SUMMARY OF THE INVENTION

Accordingly, it is an object of the present invention to provide driving method and apparatus for a plasma display panel that is capable of performing a gray scale levels linearly.

In order to achieve these and other objects of the invention, a PDP driving method according to one aspect of the present invention includes the steps of differently setting duty ratios of sustaining pulses applied in a sustaining interval in each sub-field; and combining the sub-fields in a certain arrangement sequence.

A PDP driving method according to another aspect of the present invention includes the steps of differently setting frequencies of sustaining pulses applied in a sustaining interval in each sub-field; and combining the sub-fields in a certain arrangement sequence.

A PDP driving apparatus according to still another aspect of the present invention includes duty ratio controlling means for determining a duty ratio for each sub-field; and duty ratio compensating means for adjusting a duty ratio of a sustaining pulse for each sub-field under control of the duty ratio controlling means.

A PDP driving apparatus according to still another aspect of the present invention includes frequency controlling means for determining a frequency for each sub-field; and frequency compensating means for adjusting a frequency of a sustaining pulse for each sub-field under control of the frequency controlling means.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
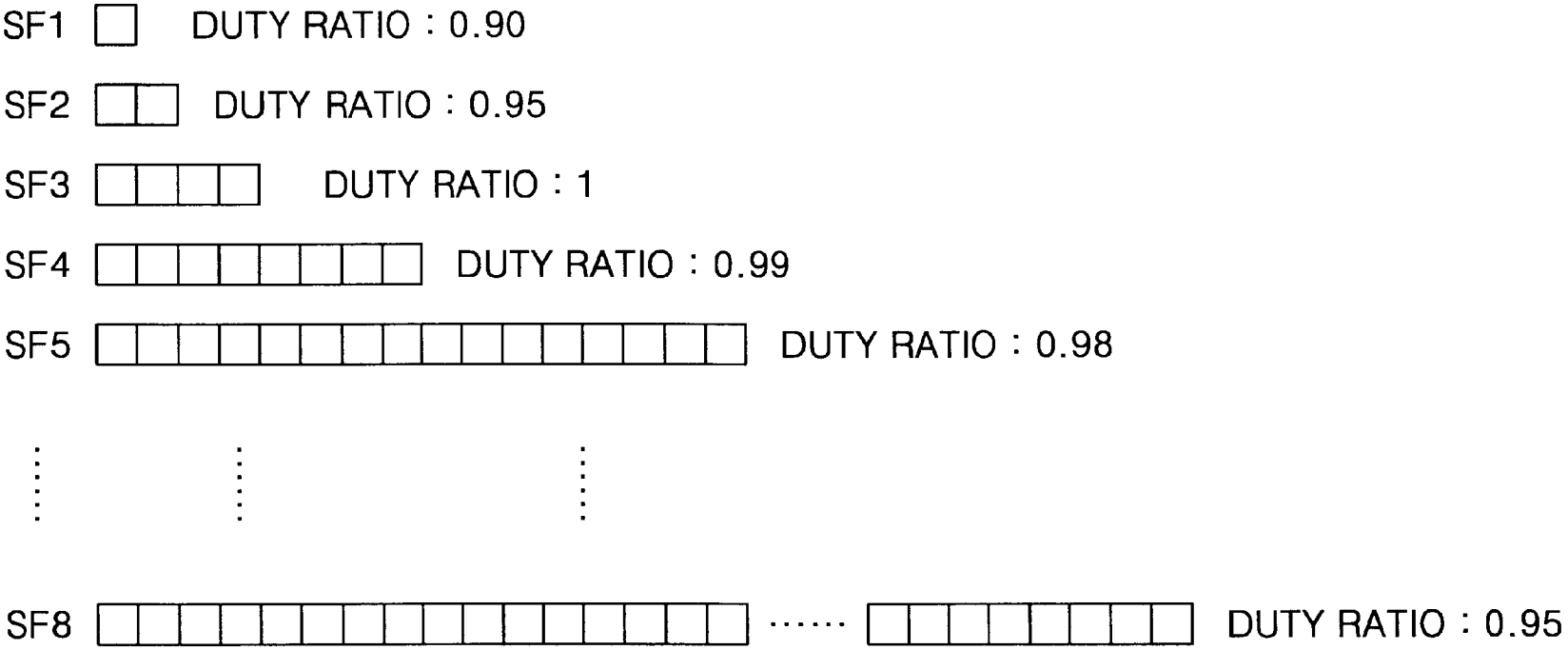
FIG. 6 represents the duty ratio of sustaining pulses applied to each sub-field in a PDP driving method according to an embodiment of the present invention.
Figure 7:
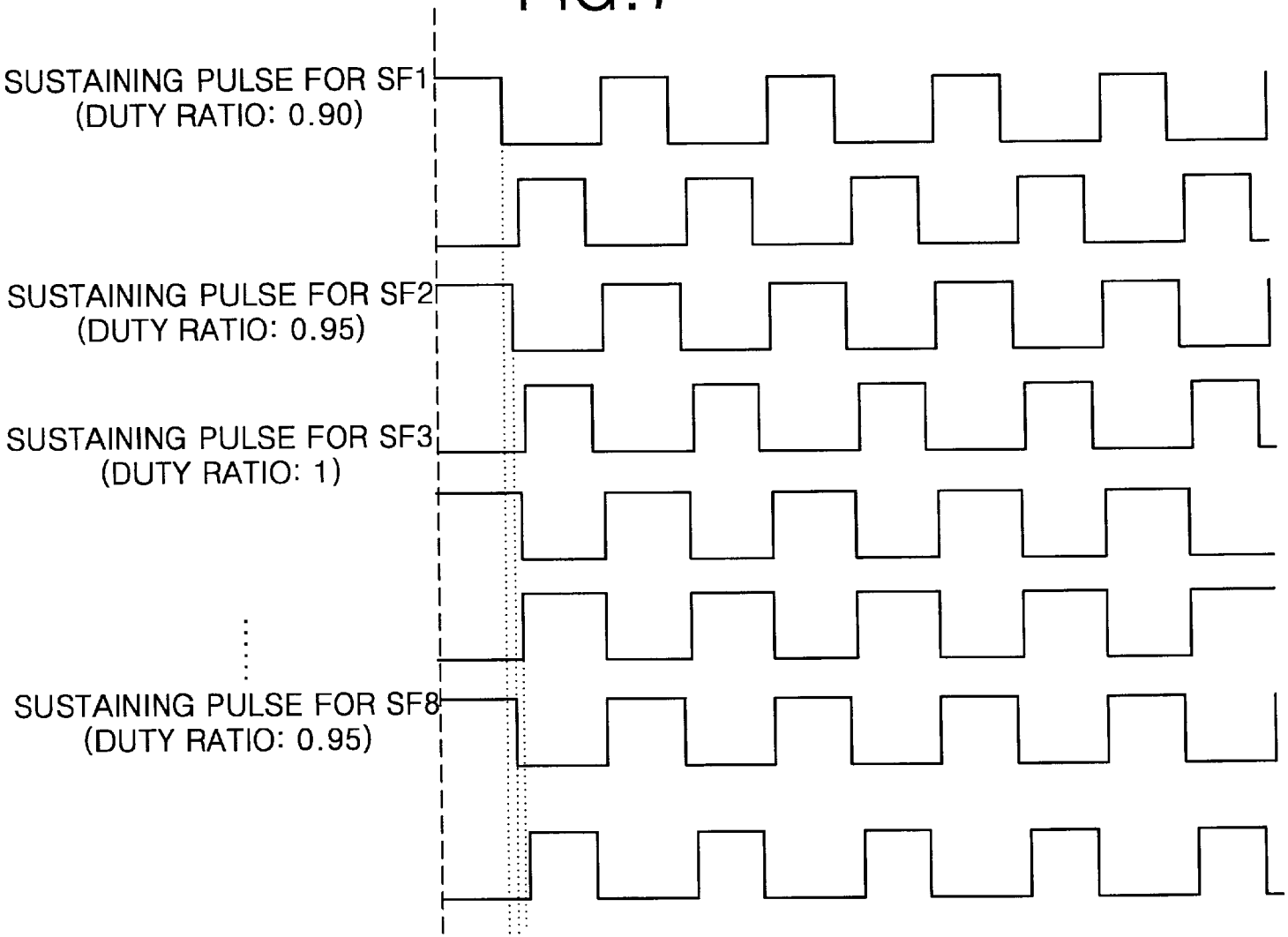
FIG. 7 is waveform diagrams of sustaining pulses in each sub-field in FIG. 6.
Figure 8:
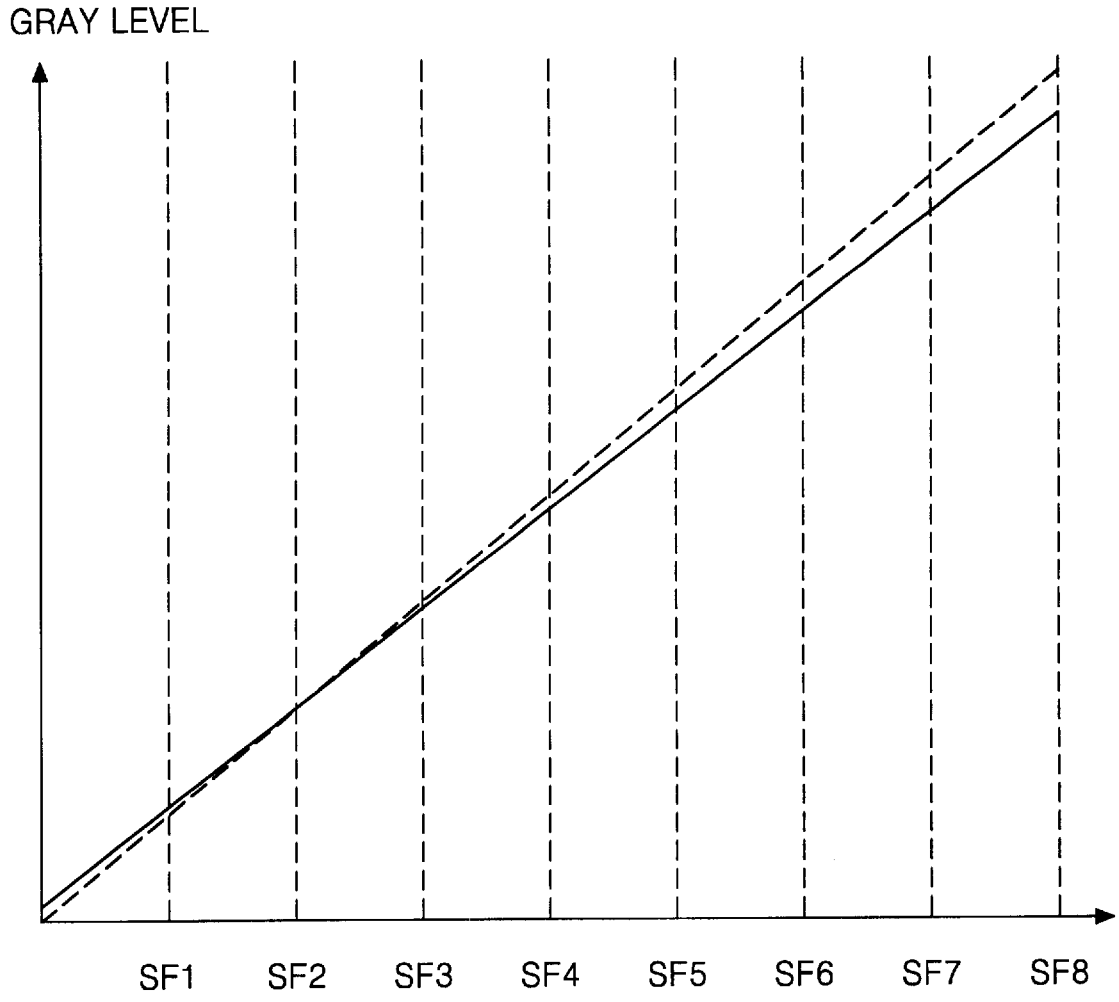
FIG. 8 is a graph for representing a non-linear gray level characteristic generated by a PDP driving method according to an embodiment of the present invention.

Referring to FIG. 6, in a PDP driving method according to the present invention, the duty ratios of sustaining pulses in each sub-field SF1 to SF8 are set to different values such that gray scale levels can be displayed. When 256 gray levels are expressed, one frame at a time interval of 16.67 ms is time-divided into 8 sub-fields SF1 to SF8. Each sub-field SF1 to SF8 is divided into a reset interval, an address interval and a sustaining interval. The reset interval and the address interval are carried out in the same manner as the prior art. The sustaining interval in each sub-field SF1 to SF8 is assigned to be increased at a ratio of 2n(n=0, 1, 2, 3, 4, 5, 6, 7) in each sub-field in accordance with a relative brightness ratio. In such a sustaining interval, sustaining pulses having a different duty ratio are applied to the scanning/sustaining electrode(Y) and the common sustaining electrode(Z) every sub-field. In this case, the duty ratio of sustaining pulses is experimentally determined such that a brightness difference between sub-fields does not exist irrespectively of an arrangement sequence of the sub-fields SF1 to SF8 in a single frame. In other words, after the brightness in each sub-field SF1 to SF8 was detected, the duty ratio is determined such that a brightness difference does not exist. For instance, as shown in FIG. 6 and FIG. 7, it is determined that the duty ratio of the sustaining pulse applied in the sustaining interval in the first sub-field SF1 is 0.90, the duty ratio of the sustaining pulse applied in the sustaining interval in the second sub-field SF2 is 0.95, and the duty ratio of the sustaining pulse applied in the sustaining interval in the third sub-field SF3 is 1. Furthermore, it is determined that the duty ratio of the sustaining pulse applied in the sustaining interval in the fourth sub-field SF4 is 1.03, the duty ratio of the sustaining pulse applied in the sustaining interval in the fifth sub-field SF5 is 0.98, . . . , and the duty ratio of the sustaining pulse applied in the sustaining interval in the eighth sub-field SF8 is 0.95. Since a wall charge amount formed every sustaining interval is controlled to have a different value when the duty ratios of sustaining pulses have been different for each sub-field SF1 to SF8, a discharge correction amount also becomes different for each sub-field SF1 to SF8. As a result, as seen from FIG. 8, the gray scale levels are linearly increased from level 1 to level 256 without any discontinuation between sub-fields.

Figure 1:
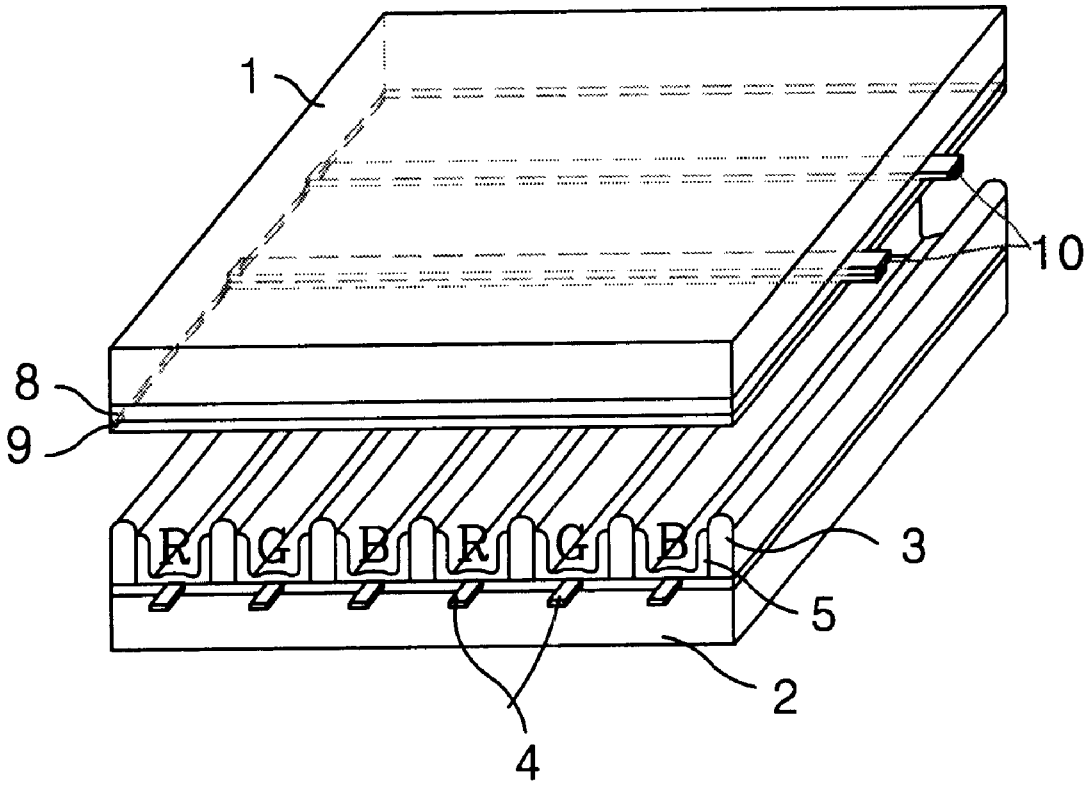
FIG. 1 RELATED ART
FIG. 1 is a perspective view showing the structure of a conventional AC-type plasma display panel.
Figure 2:
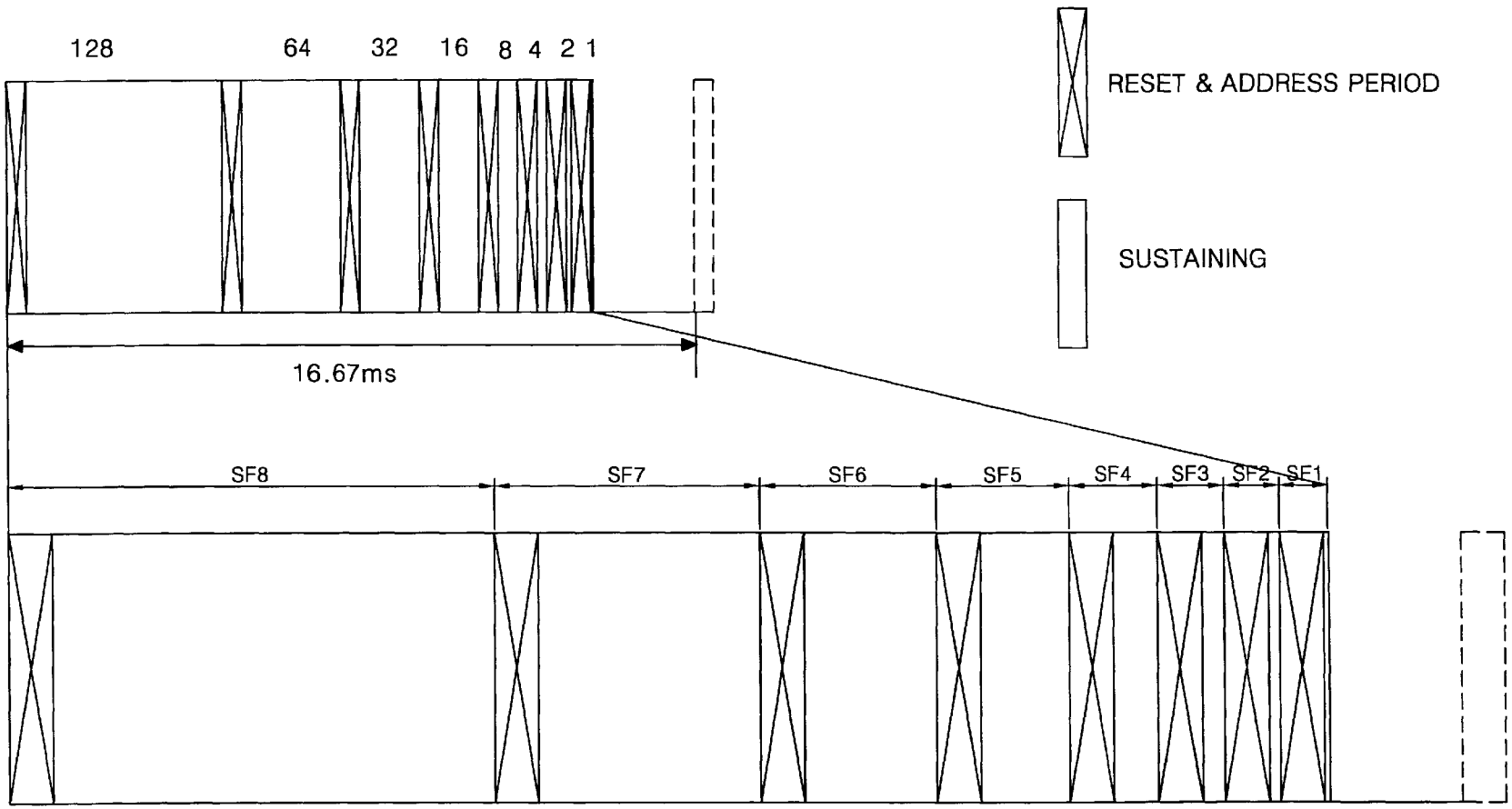
FIG.2 RELATED ART
FIG. 2 schematically illustrates a single frame configuration in the conventional sub-field driving system.
Figure 3:
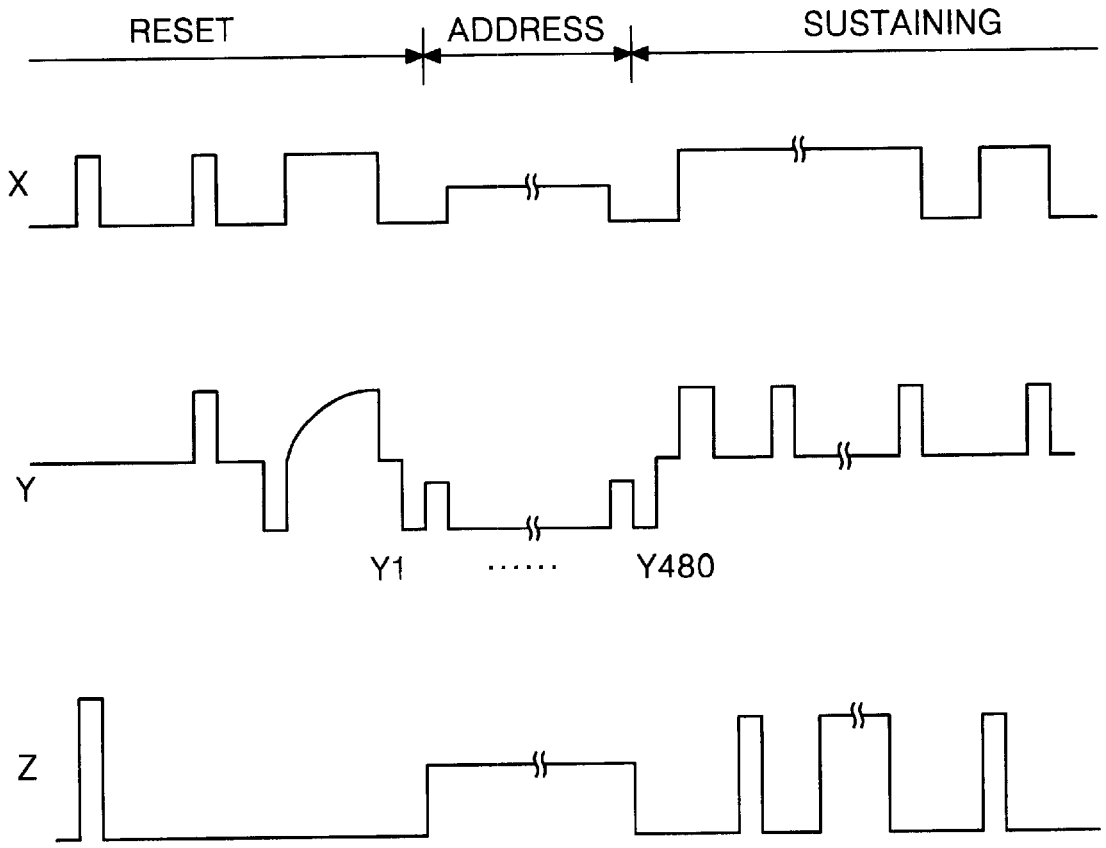
FIG.3 RELATED ART
FIG. 3 is waveform diagrams of driving signals applied to one sub-field in FIG. 2.
Figure 4:
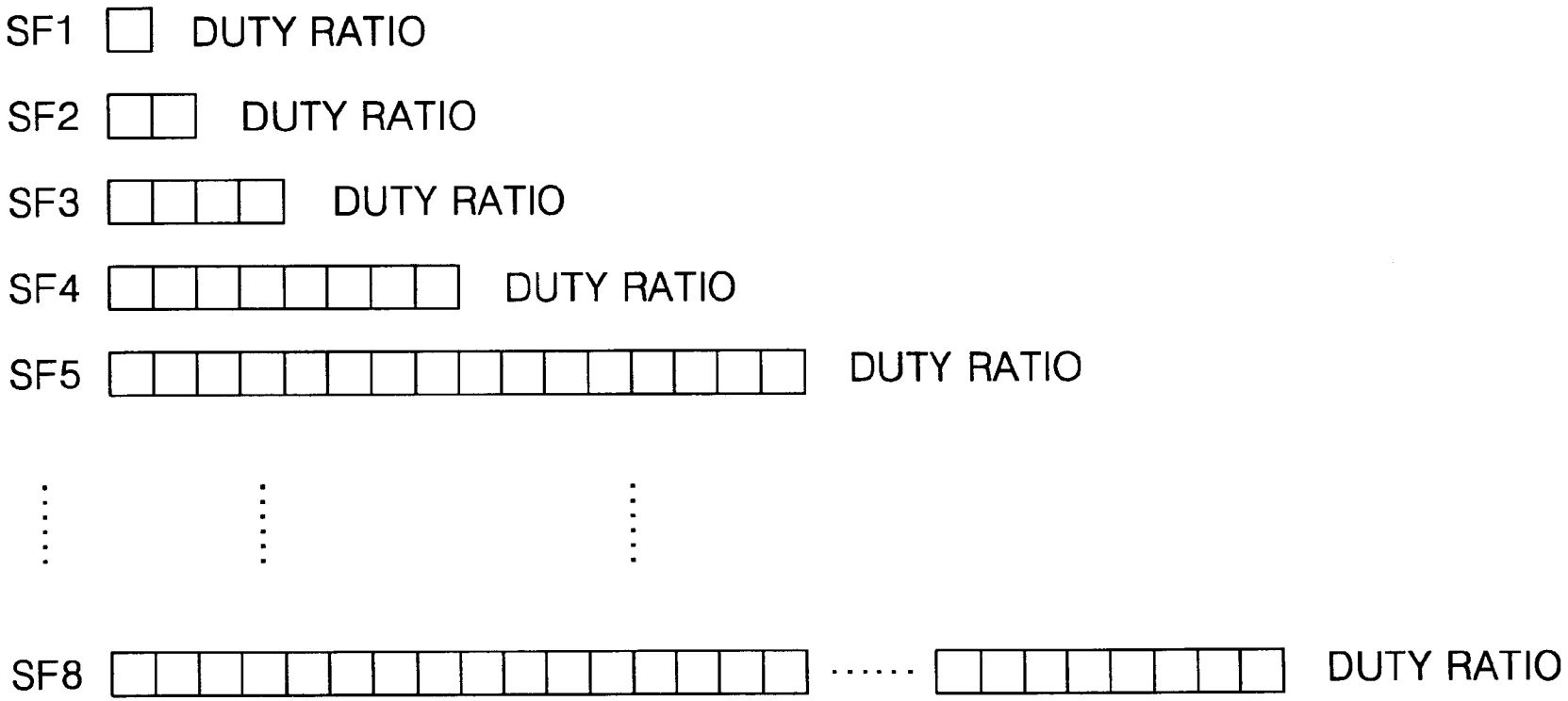
FIG. 4 represents the duty ratio of sustaining pulses applied to each sub-field in FIG. 2.
Figure 5:
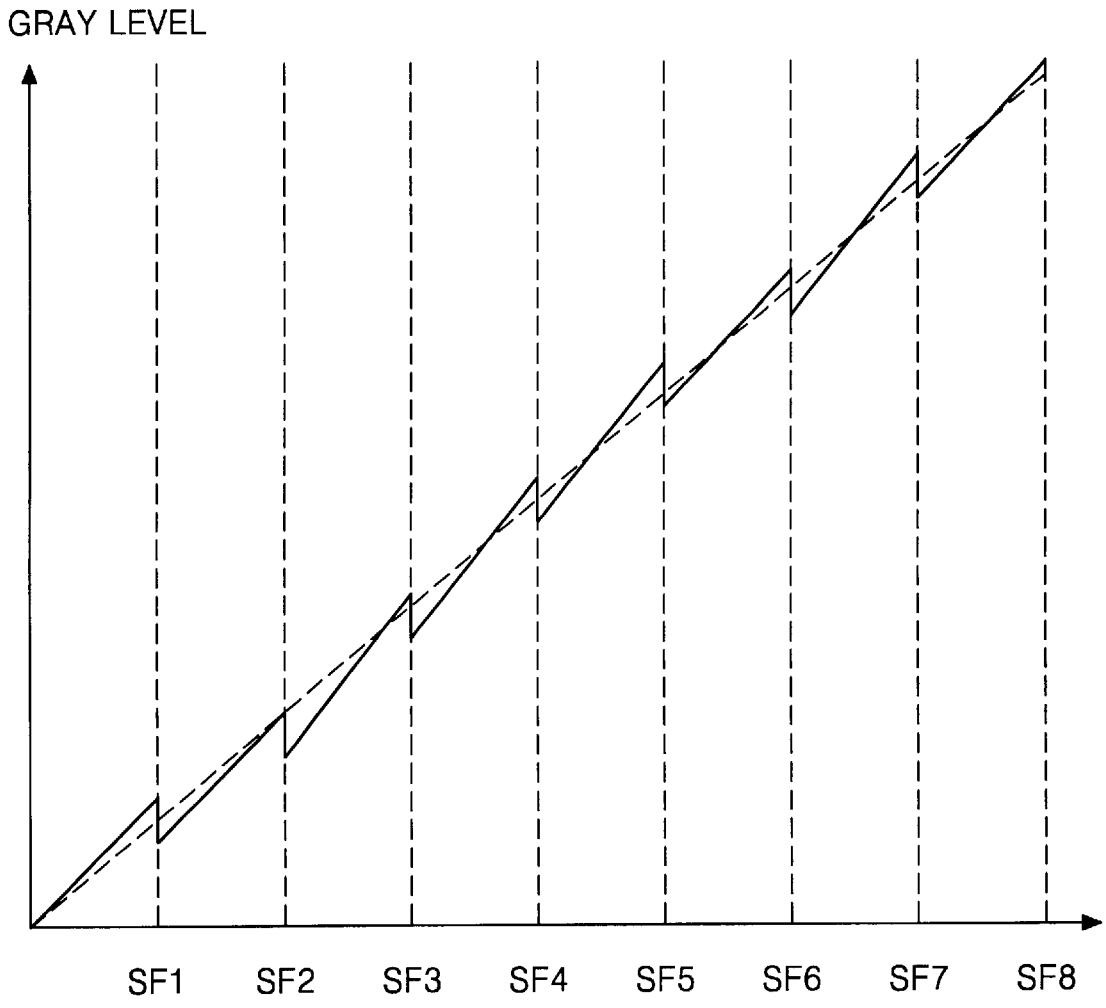
FIG. 5 RELATED ART
FIG. 5 is a graph for representing a non-linear gray level characteristic generated by the conventional PDP driving method.

When the gray level values 127 and 128 are expressed, a discontinuous change of brightness occurs due to a discharge frequency difference of the values 127 and 128 as shown in FIG. 4 in the prior art. On the other hand, in the present invention, the duty ratio of the sustaining pulse applied to display gray level 127 which is consist of from the first sub-field SF1 through the seventh sub-field SF7 becomes much smaller compared to prior art, and the duty ratio of the sustaining pulse applied to the eighth sub-field SF8 for expressing the gray level value 128 is slightly lowered into 0.95. Accordingly, when the gray level value 127 and 128 are expressed, the discharge frequency is different, but a discharge correction amount becomes different in expressing the gray levels of 127 and 128, so that the brightness difference can be minimized.

The brightness and gray level difference between sub-fields is corrected by adjusting the duty ratio in the above-mentioned embodiment, but it may be corrected by adjusting a frequency of the sustaining pulse. In this case, a frequencies of the sustaining pulse applied to each sub-fields, from SF1 to SF8, are experimentally determined such that the change brightness of from the sub-field 1 to 8 can be linearized irrespectively of an arrangement sequence of the sub-fields like the determination method of duty ratio as mentioned above.

Figure 9:
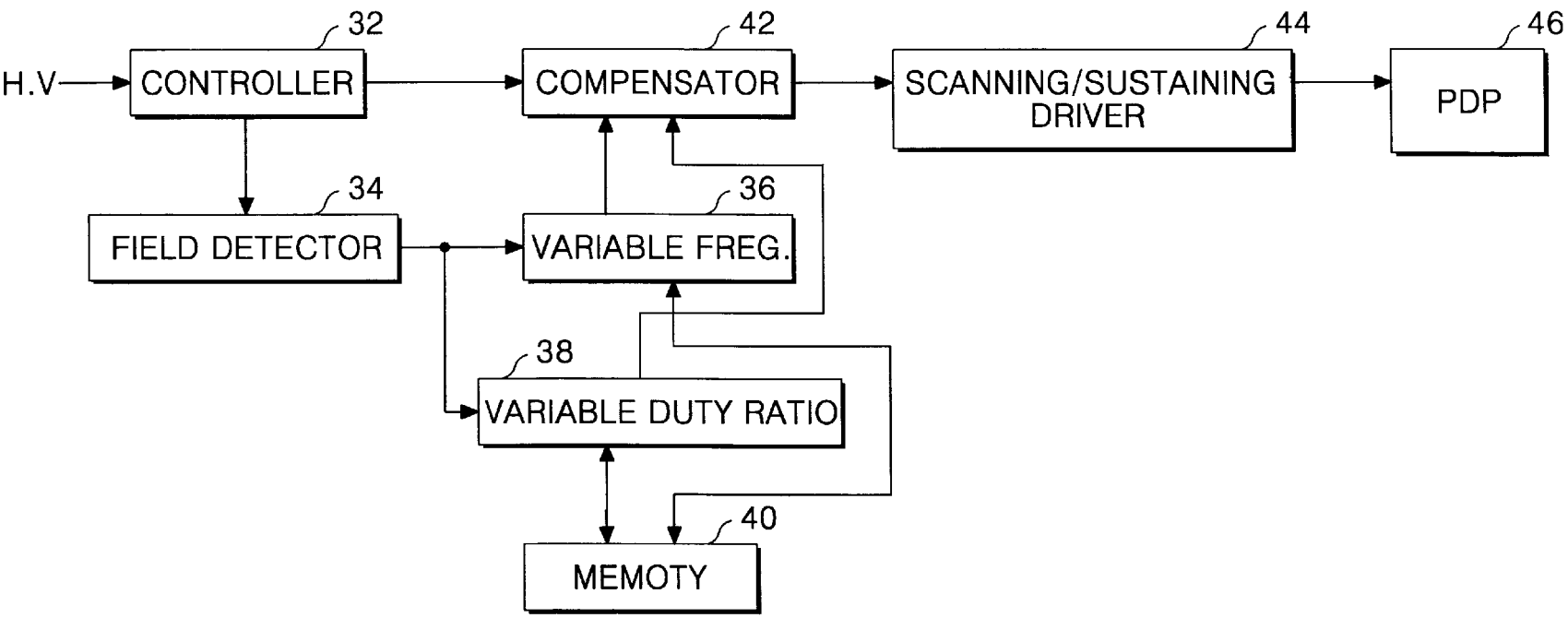
FIG. 9 is a schematic block diagram showing the configuration of a PDP driving apparatus according to an embodiment of the present invention.

Referring now to FIG. 9, there is shown a PDP driving apparatus according to an embodiment of the present invention. The PDP driving apparatus includes a controller 32 for receiving vertical and horizontal synchronizing signals H and V, a field detector 34 connected to the controller 32 to detect sub-fields, a variable frequency part 36 and a variable duty ratio part 38 connected, in parallel, to the controller 32 to vary a frequency and a duty ratio in accordance with the sub-fields, a compensator 42 for controlling a scanning/sustaining driver 44 in accordance with a control signal applied from the variable frequency part 36 and the variable duty ratio 38, and a memory 40 connected commonly to the variable frequency part 36 and the variable duty ratio part 38 to store a frequency information and a duty ratio information for each sub-field. The controller 32 applies the horizontal and vertical synchronizing signals H and V to the field detector 34 and the compensator 42 commonly. The field detector 34 counts the vertical synchronizing signal V by a desired clock from an initiation time of the vertical synchronizing signal V to detect the current sub-field. The variable frequency part 36 reads a frequency of the sustaining pulse corresponding to the current sub-field in accordance with a sub-field detection information from the field detector 34. The variable duty ratio part 38 reads a duty ratio of the sustaining pulse corresponding to the current sub-field in accordance with the sub-field detection information from the field detector 34. To this end, the frequency and duty ratio of the sustaining pulse determined experimentally for each sub-field is stored into a look-up table in the memory 40. The compensator 42 controls the duty ratio and the frequency of the sustaining pulse generated from the scanning/sustaining driver 44 in accordance with a duty ratio information and a frequency information from the variable duty ratio part 38 and the variable frequency part 36. The scanning/sustaining driver 44 generates sustaining pulses having a different frequency and duty ratio for each sub-field under control of the compensator 42. The sustaining pulses having a different frequency and duty ratio for each sub-field are applied to the scanning/sustaining electrodes in the PDP 46.

When any one of the duty ratio and the frequency is corrected differently for each sub-field, any one of the variable frequency part 36 and the variable duty ratio part 38 can be eliminated.

As described above, according to the present invention, the duty ratio and/or the frequency in each sub-field is controlled to thereby maintain constant brightness ratio between sub-fields. Accordingly, a gray level can be linearly expressed. Furthermore, the PDP driving method and apparatus can stabilize a discharge characteristic in the discharge cells in the sustaining interval, thereby preventing a misdischarge or a malfunction as well as removing a moving picture pseudo contour noise.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel with one frame divided into a plurality of sub-fields in accordance with a relative brightness ratio, comprising:

setting different duty ratios of sustaining pulses applied in a sustaining interval in each sub-field; and combining the sub-fields in a certain arrangement sequence.

2. The method as claimed in claim 1, wherein said duty ratios are experimentally determined to correct corresponding brightness of the sub-fields after measuring the brightness in each sub-field, wherein said each sub-field uses a separate one of said different duty ratios.

3. A method of driving a plasma display panel with one frame divided into a plurality of sub-fields in accordance with a relative brightness ratio, comprising:

setting different frequencies of sustaining pulses applied in a sustaining interval in each sub-field; and combining the sub-fields in a certain arrangement sequence.

4. The method as claimed in claim 3, wherein said frequencies of the sustaining pulses are experimentally determined to correct corresponding brightness of the sub-fields after measuring the brightness in each sub-field, wherein said each sub-field uses a separate one of said different duty ratios.

5. An apparatus for driving a plasma display panel with one frame divided into a plurality of sub-fields in accordance with a relative brightness ratio, comprising:

a duty ratio controlling device for determining a duty ratio for each sub-field in the frame; and a duty ratio compensating device for adjusting the duty ratio of a sustaining pulse for said each sub-field controlled by the duty ratio controlling device.

6. The apparatus as claimed in claim 5, wherein said duty ratio controlling device comprises:

a sub-field detector for detecting information of the sub-fields;

a memory for storing the duty ratio information set for each sub-field; and a variable duty ratio part for reading the duty ratio information in accordance with a sub-field information detected by the duty ratio controlling device.

7. The apparatus as claimed in claim 6, wherein said duty ratio compensating device comprises:

a scanning/sustaining driver for applying sustaining pulses to scanning/sustaining electrodes in the plasma display panel; and a compensator for adjusting the duty ratios of the sustaining pulses in accordance with the duty ratio information supplied from the variable duty ratio part, wherein the duty ratio controlling device determines a different duty ratio for at least two sub-fields in the frame.

8. An apparatus for driving a plasma display panel with one from divided into a plurality of sub-fields in accordance with a relative brightness ratio, comprising:

a frequency controlling device for determining a different frequency for at least two sub-fields of the frame; and a frequency compensating device for adjusting a frequency of a sustaining pulse for each sub-field controlled by the frequency controlling device.

9. The apparatus as claimed in claim 8, wherein said frequency controlling device comprises:

a sub-field detector for detecting a frequency information of the sub-fields;

a memory for storing the frequency information set for each sub-field; and a variable frequency part for reading the frequency information in accordance with a sub-field information detected by the frequency controlling device.

10. The apparatus as claimed in claim 9, wherein said frequency compensating device comprises:

a scanning/sustaining driver for applying sustaining pulses to scanning/sustaining electrodes in the plasma display panel; and a compensator for adjusting the frequencies of the sustaining pulses in accordance with a duty ratio information supplied from the variable frequency part.

11. A method for driving a display, comprising:

dividing a frame into a plurality of sub-fields;

applying a relative brightness ratio to the plurality of sub-fields; and displaying substantially linear grey scale level values between at least two of the plurality of sub-fields by using different duty ratios for sustaining pulses of said at least two of the sub-fields in the frame.

12. The method as claimed in claim 11, further comprising:

setting different duty ratios of sustaining pulses applied in a sustaining interval in each sub-field; and combining the sub-fields in a prescribed sequence.

13. The method as claimed in claim 12, wherein said duty ratios are determined based on a measurement of the brightness applied in said each sub-field.

14. The method as claimed in claim 13, wherein setting said duty ratios further comprises:

detecting information of the sub-fields by utilizing a sub-field detector;

storing a duty ratio information for said each sub-field; and reading the duty ratio information in accordance with a corresponding detected sub-field information.

15. The method as claimed in claim 14, wherein setting said duty ratios further comprises:

applying sustaining pulses to a plurality of scanning electrodes in the display;

applying sustaining pulses to a plurality of sustaining electrodes in the display; and adjusting the duty ratios of the sustaining pulses in accordance with the read duty ratio information.

16. The method as claimed in claim 11, further comprising:

setting different frequencies of sustaining pulses applied in a sustaining interval in each sub-field; and combining the sub-fields in a prescribed sequence.

17. The method as claimed in claim 16, wherein said frequencies are determined based on a measurement of the brightness applied in said each sub-field.

18. The method as claimed in claim 17, wherein setting said frequencies further comprises:

detecting information of the sub-fields by utilizing a sub-field detector;

storing frequency information for said each sub-field; and reading the frequency information in accordance with a corresponding detected sub-field information.

19. The method as claimed in claim 18, wherein setting said frequency further comprises:

applying sustaining pulses to a plurality of scanning electrodes in the display;

applying sustaining pulses to a plurality of sustaining electrodes in the display; and adjusting the frequencies of the sustaining pulses in accordance with the read frequency information.

* * * * *